US007168932B2

(12) United States Patent
Lassig et al.

(10) Patent No.: US 7,168,932 B2
(45) **Date of Patent: *Jan. 30, 2007**

(54) APPARATUS FOR NONWOVEN FIBROUS WEB

(75) Inventors: John Joseph Lassig, Cumming, GA (US); Michael C. Cook, Marietta, GA (US); Bryan David Haynes, Advance, NC (US); Vicky Susan Smith, Roswell, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 237 days.

This patent is subject to a terminal disclaimer.

(21) Appl. No.: 10/743,860

(22) Filed: Dec. 22, 2003

(65) Prior Publication Data

US 2005/0136781 A1 Jun. 23, 2005

(51) Int. Cl.
*B29C 47/08* (2006.01)

(52) U.S. Cl. ..... 425/72.2; 156/167; 156/176; 425/131.5; 425/382.2; 425/463

(58) Field of Classification Search ..... 425/72.2, 425/131.5, 382.2, 463; 156/436, 176, 166, 156/167

See application file for complete search history.

(56) References Cited

U.S. PATENT DOCUMENTS

| | | | | |
|---|---|---|---|---|
| 3,249,669 | A | 5/1966 | Jamieson | |
| 3,457,341 | A | 7/1969 | Duncan et al. | |
| 3,659,988 | A * | 5/1972 | Walczak | 425/131.5 |
| 3,692,618 | A | 9/1972 | Dorschner et al. | |
| 3,802,817 | A | 4/1974 | Matsuki et al. | |
| 3,806,289 | A | 4/1974 | Schwarz | |
| 3,849,241 | A | 11/1974 | Butin et al. | |
| 3,878,992 | A * | 4/1975 | MacManus | 239/553 |
| 3,981,650 | A | 9/1976 | Page | |
| 4,242,075 | A * | 12/1980 | Higuchi et al. | 425/462 |
| 4,254,076 | A * | 3/1981 | Pfeiffer et al. | 264/206 |
| 4,322,202 | A * | 3/1982 | Martinez | 425/208 |
| 4,340,563 | A | 7/1982 | Appel et al. | |
| 4,473,387 | A * | 9/1984 | Lecron et al. | 65/496 |
| 4,708,619 | A | 11/1987 | Balk | |

(Continued)

FOREIGN PATENT DOCUMENTS

EP 0677600 A1 10/1995

(Continued)

OTHER PUBLICATIONS

ASTM Designation: D 5034-90, "Standard Test Method for Breaking Force and Elongation of Textile Fabrics", Published May 1990, pp. 725-731.

(Continued)

*Primary Examiner*—Yogendra N. Gupta
*Assistant Examiner*—Emmanuel S. Luk
(74) *Attorney, Agent, or Firm*—Robert A. Ambrose

(57) ABSTRACT

Disclosed is an apparatus for producing nonwoven fibrous webs. The apparatus comprises an extrusion die, first and second fluid supplies in cooperation with the die, first and second extrusion capillaries, first counterbores allowing fluid communication between first capillaries and first supply and second counterbores allowing fluid communication between second capillaries and second supply, each first counterbore having at least two first capillaries extending therefrom.

6 Claims, 5 Drawing Sheets

U.S. PATENT DOCUMENTS 4,714,647 A 12/1987 Shipp, Jr. et al.
4,720,252 A 1/1988 Appel et al.
4,934,916 A * 6/1990 Lambertus ..... 425/67
5,094,606 A * 3/1992 Lambertus ..... 425/311
5,108,820 A 4/1992 Kaneko et al.
5,145,689 A * 9/1992 Allen et al. ..... 425/72.2
5,272,236 A 12/1993 Lai et al.
5,277,855 A * 1/1994 Blackmon et al. ..... 264/103
5,278,272 A 1/1994 Lai et al.
5,332,613 A 7/1994 Taylor et al.
5,336,552 A 8/1994 Strack et al.
5,382,400 A 1/1995 Pike et al.
5,466,410 A 11/1995 Hills
5,539,056 A 7/1996 Yang et al.
5,562,930 A 10/1996 Hills
5,596,052 A 1/1997 Resconi et al.
5,601,773 A * 2/1997 Schmidt et al. ..... 264/328.8
5,618,566 A 4/1997 Allen et al.
5,679,042 A * 10/1997 Varona ..... 442/347
5,733,581 A 3/1998 Barboza et al.
5,853,635 A 12/1998 Morell et al.
5,882,573 A 3/1999 Kwok et al.
5,891,482 A 4/1999 Choi
5,902,540 A 5/1999 Kwok
5,904,298 A 5/1999 Kwok et al.
5,965,468 A 10/1999 Marmon et al.
5,976,427 A 11/1999 Choi
6,103,181 A 8/2000 Berger
6,164,950 A * 12/2000 Barbier et al. ..... 425/378.2
6,183,670 B1 2/2001 Torobin et al.
6,220,843 B1 4/2001 Allen
6,315,806 B1 11/2001 Torobin et al.
6,446,691 B1 9/2002 Maldonado et al.
6,461,133 B1 10/2002 Lake et al.
6,474,967 B1 11/2002 Haynes et al.
6,565,344 B2 5/2003 Bently et al.
6,576,034 B2 6/2003 Berger
6,579,084 B1 * 6/2003 Cook ..... 425/463
6,596,049 B1 7/2003 Berger
6,602,311 B2 8/2003 Berger
2002/0034909 A1 3/2002 Bansal et al.

FOREIGN PATENT DOCUMENTS

EP 0 893 517 A2 1/1999
EP 1 239 065 A1 9/2002
EP 1239064 A1 9/2002
WO WO 02/12601 A1 2/2002
WO WO 02/52074 A1 7/2002

OTHER PUBLICATIONS

Method 5514, Federal Test Method Standard No. 191A, Jul. 1978, "Water Resistance of Cloth; Low Range, Hydrostatic Pressure Method.".
Method 5450, Federal Test Method Standard No. 191A, "Permeability to Air; Cloth; Calibrated Orifice Method", Jul. 1978.
Patent Abstracts of Japan, JP 04222203, Aug. 12, 1992, Teijin Ltd.

* cited by examiner

APPARATUS FOR NONWOVEN FIBROUS WEB

BACKGROUND OF THE INVENTION

Many of the medical care garments and products, protective wear garments, mortuary and veterinary products, and personal care products in use today are partially or wholly constructed of extruded filamentary or fibrous web materials such as nonwoven web materials. Examples of such products include, but are not limited to, medical and health care products such as surgical drapes, gowns and bandages, protective workwear garments such as coveralls and lab coats, and infant, child and adult personal care absorbent articles such as diapers, training pants, disposable swimwear, incontinence garments and pads, sanitary napkins, wipes and the like. Other uses for nonwoven web materials include geotextiles and house wrap materials. For these applications nonwoven web materials provide functional, tactile, comfort and/or aesthetic properties that can approach or even exceed those of traditional woven textiles or knitted cloth materials.

The size, composition and shape of the fibers in the nonwoven web have a significant impact on the functional, tactile, comfort and/or aesthetic properties and there is a continuing need for efficient fiber extrusion apparatus and methods which offer the ability to produce nonwoven webs having a plurality of fiber types and thus a plurality of types of physical properties.

SUMMARY OF THE INVENTION

The present invention provides an apparatus and method for the production of nonwoven fibrous webs. The apparatus comprises an extrusion die, first and second fluid supplies in cooperation with the extrusion die, a plurality of first extrusion capillaries and a plurality of second extrusion capillaries, first counterbores allowing fluid communication between the first extrusion capillaries and first fluid supply and second counterbores allowing fluid communication between the second extrusion capillaries and second fluid supply, where each of the first counterbores has at least two first extrusion capillaries extending therefrom and each of the second counterbores has at least one of the second extrusion capillaries extending therefrom. In embodiments, each of the first counterbores may have at least three of the first extrusion capillaries extending therefrom. In other embodiments, the second counterbores may have at least two of the second extrusion capillaries extending therefrom. The apparatus may desirably comprise between 2 and about 20 counterbores per inch of the die. In further embodiments, the apparatus may desirably comprise a third fluid supply, where the second counterbores allow fluid communication between the second extrusion capillaries and the third fluid supply. In still further embodiments, the apparatus may desirably comprise a third fluid supply, a plurality of third extrusion capillaries and third counterbores allowing fluid communication between the third extrusion capillaries and the third fluid supply.

The method comprises the steps of providing an extrusion die in communication with a first and second fluid supplies, the die comprising a first plurality and a second plurality of extrusion capillaries, the die further comprising first counterbores allowing fluid communication between the first capillaries and first fluid supply, and second counterbores allowing fluid communication between the second capillaries and second fluid supply, where each of the first counterbores has at least two of the first capillaries extending therefrom and each of the second counterbores has at least one of the second capillaries extending therefrom, providing to the extrusion die a first fluidized polymer and a second fluid, conveying the first fluidized polymer through the first supply, the first counterbores and first capillaries to extrude a first plurality of fibers, and conveying the second fluid through the second supply, second counterbores and second capillaries. In embodiments, the second fluid may comprise a fiber treatment composition. In other embodiments, the second fluid may comprise a fluidized polymer. The second counterbores may each have at least two of the extrusion capillaries extending therefrom. In still other embodiments, the first and second fluids may each be fluidized polymers provided to the extrusion die at different flow rates. Also provided are nonwoven webs produced in accordance with embodiments of the method. In embodiments, a nonwoven web thus provided may comprise alternating first and second regions, where the first region comprises by majority a first fiber type and the second region comprises by majority a second fiber type.

DEFINITIONS

Figure 1A:
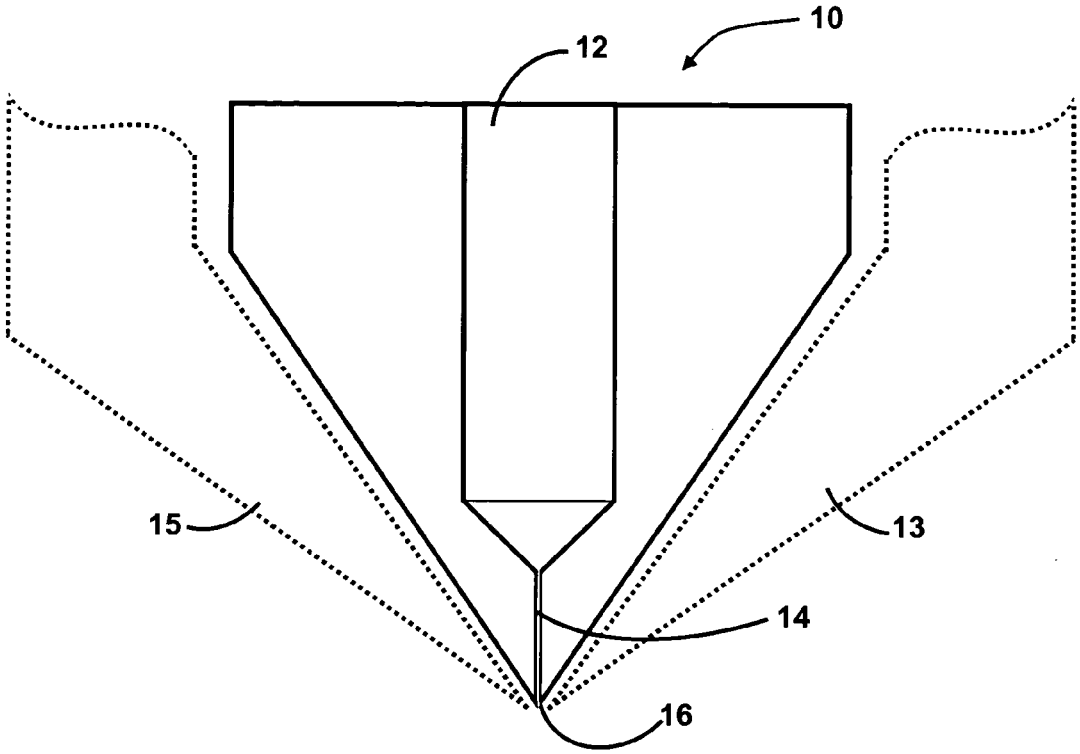
FIG. 1A (Prior Art)
FIGS. 1A–1B illustrate schematically a meltblown die.

As used herein and in the claims, the term "comprising" is inclusive or open-ended and does not exclude additional unrecited elements, compositional components, or method steps. Accordingly, the term "comprising" encompasses the more restrictive terms "consisting essentially of" and "consisting of".

As used herein the term "polymer" generally includes but is not limited to, homopolymers, copolymers, such as for example, block, graft, random and alternating copolymers, terpolymers, etc. and blends and modifications thereof. Furthermore, unless otherwise specifically limited, the term "polymer" shall include all possible geometrical configurations of the material. These configurations include, but are not limited to isotactic, syndiotactic and random symmetries. As used herein the term "thermoplastic" or "thermoplastic polymer" refers to polymers that will soften and flow or melt when heat and/or pressure are applied, the changes being reversible.

As used herein the term "fibers" refers to both staple length fibers and substantially continuous filaments, unless otherwise indicated. As used herein the term "substantially continuous" with respect to a filament or fiber means a filament or fiber having a length much greater than its diameter, for example having a length to diameter ratio in excess of about 15,000 to 1, and desirably in excess of 50,000 to 1.

As used herein the term "monocomponent" fiber refers to a filament or fiber formed from one or more extruders using only one polymer. This is not meant to exclude fibers or filaments formed from one polymer to which small amounts of additives have been added for color, anti-static properties, lubrication, hydrophilicity, etc.

As used herein the term "multicomponent fibers" refers to fibers or filaments that have been formed from at least two component polymers, or the same polymer with different properties or additives, extruded from separate extruders but spun together to form one fiber. Multicomponent fibers are also sometimes referred to as conjugate fibers or bicomponent fibers, although more than two components may be used. The polymers are arranged in substantially constantly positioned distinct zones across the cross-section of the multicomponent fibers and extend continuously along the length of the fibers. The configuration of such a multicomponent fiber may be, for example, a concentric or eccentric sheath/core arrangement wherein one polymer is surrounded by another, or may be a side by side arrangement, an "islands-in-the-sea" arrangement, or arranged as pie-wedge shapes or as stripes on a round, oval or rectangular cross-section fiber, or other. Multicomponent fibers are taught in U.S. Pat. No. 5,108,820 to Kaneko et al., U.S. Pat. No. 5,336,552 to Strack et al., and U.S. Pat. No. 5,382,400 to Pike et al. For two component fibers, the polymers may be present in ratios of 75/25, 50/50, 25/75 or any other desired ratios. In addition, any given component of a multicomponent fiber may desirably comprise two or more polymers as a multiconstituent blend component.

As used herein the term "biconstituent fiber" or "multiconstituent fiber" refers to a fiber or filament formed from at least two polymers, or the same polymer with different properties or additives, extruded from the same extruder as a blend. Multiconstituent fibers do not have the polymer components arranged in substantially constantly positioned distinct zones across the cross-section of the fibers; the polymer components may form fibrils or protofibrils that start and end at random.

As used herein the term "nonwoven web" or "nonwoven fabric" means a web having a structure of individual filaments or fibers that are interlaid, but not in an identifiable manner as in a knitted or woven fabric. Nonwoven fabrics or webs have been formed from many processes such as for example, meltblowing processes, spunbonding processes, airlaying processes, and carded web processes. The basis weight of nonwoven fabrics is usually expressed in grams per square meter (gsm) or ounces of material per square yard (osy) and the fiber diameters useful are usually expressed in microns. (Note that to convert from osy to gsm, multiply osy by 33.91).

The term "spunbond" or "spunbond nonwoven web" refers to a nonwoven fiber or filament material of small diameter fibers that are formed by extruding molten thermoplastic polymer as fibers from a plurality of capillaries of a spinneret. The extruded fibers are cooled while being drawn by an eductive or other well known drawing mechanism. The drawn fibers are deposited or laid onto a forming surface in a generally random manner to form a loosely entangled fiber web, and then the laid fiber web is subjected to a bonding process to impart physical integrity and dimensional stability. The production of spunbond fabrics is disclosed, for example, in U.S. Pat. No. 4,340,563 to Appel et al., U.S. Pat. No. 3,692,618 to Dorschner et al., and U.S. Pat. No. 3,802,817 to Matsuki et al. Typically, spunbond fibers or filaments have a weight-per-unit-length in excess of about 1 denier and up to about 6 denier or higher, although both finer and heavier spunbond fibers can be produced. In terms of fiber diameter, spunbond fibers often have an average diameter of larger than 7 microns, and more particularly between about 10 and about 25 microns, and up to about 30 microns or more.

As used herein the term "meltblown fibers" means fibers or microfibers formed by extruding a molten thermoplastic material through a plurality of fine, usually circular, die capillaries as molten threads or filaments or fibers into converging high velocity gas (e.g. air) streams that attenuate the fibers of molten thermoplastic material to reduce their diameter. Thereafter, the meltblown fibers are carried by the high velocity gas stream and are deposited on a collecting surface to form a web of randomly dispersed meltblown fibers. Such a process is disclosed, for example, in U.S. Pat. No. 3,849,241 to Buntin. Meltblown fibers may be continuous or discontinuous, are often smaller than 10 microns in average diameter and are frequently smaller than 7 or even 5 microns in average diameter, and are generally tacky when deposited onto a collecting surface.

DETAILED DESCRIPTION OF THE INVENTION

The present invention provides an apparatus and method for making nonwoven webs comprising a plurality of fiber types. The invention will be described with reference to the following Figures which illustrate certain embodiments. It will be apparent to those skilled in the art that these embodiments do not represent the full scope of the invention which is broadly applicable in the form of variations and equivalents as may be embraced by the claims appended hereto. Furthermore, features described or illustrated as part of one embodiment may be used with another embodiment to yield still a further embodiment. It is intended that the scope of the claims extend to all such variations and equivalents.

Figure 1B:
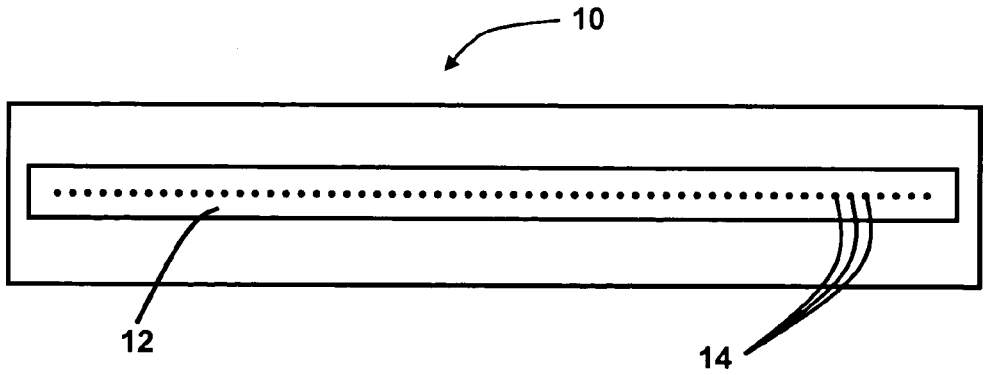

FIG. 1A illustrates in side view a cut-away diagram of a meltblowing type die as is generally known in the art. As can be seen in FIG. 1A, the meltblown die generally comprises a single deep polymer distribution channel 12 which is a cavity formed as a slot in the die 10 and extending substantially the width of the die 10, and extrusion capillaries 14 are drilled or otherwise formed extending from the bottom of the polymer distribution slot to the extrusion edge 16 of the die. FIG. 1B shows schematically a top view (rotated 90 degrees) of the meltblown die shown in FIG. 1A. As can be seen in FIG. 1B, the die 10 includes polymer distribution channel 12 which is a cavity running along the majority of the width of the die 10 and a plurality of extrusion capillaries 14, which are generally arranged in a single row along the cross machine direction width of the meltblown die. In use, molten polymer is supplied or pumped to the die 10 by a fluid supply such as polymer piping (not shown) and, because all the elements of the extrusion die are in uninterrupted fluid communication, the polymer is conveyed or flows through polymer distribution channel 12 to extrusion capillaries 14 and is extruded as fine threads or filaments or fibers of molten polymer (not shown) from capillaries 14 at extrusion edge 16.

Typically, the fibers or filaments of molten polymer are extruded into converging high velocity gas streams (such as heated or unheated air) which draw or attenuate the fibers of molten thermoplastic material to reduce their diameter. The converging high velocity gas streams are supplied along the sides of the meltblown die through the slots formed between the die and the air plates 13 and 15 that are shown in FIG.

1A in phantom. Air plates for a meltblowing apparatus are well known to those of ordinary skill in the art and thus are not described here in detail. Generally, the air plates may be configured such that the extrusion edge of the meltblown die is flush with the bottom of the air plates (at the same level), or the extrusion edge of the meltblown die may be recessed, or the extrusion edge of the meltblown die may protrude outward farther than the air plates. After being drawn, the fibers may desirably be collected as a nonwoven web on a surface such as a moving belt or other forming surface as is known in the art.

Figure 2A:
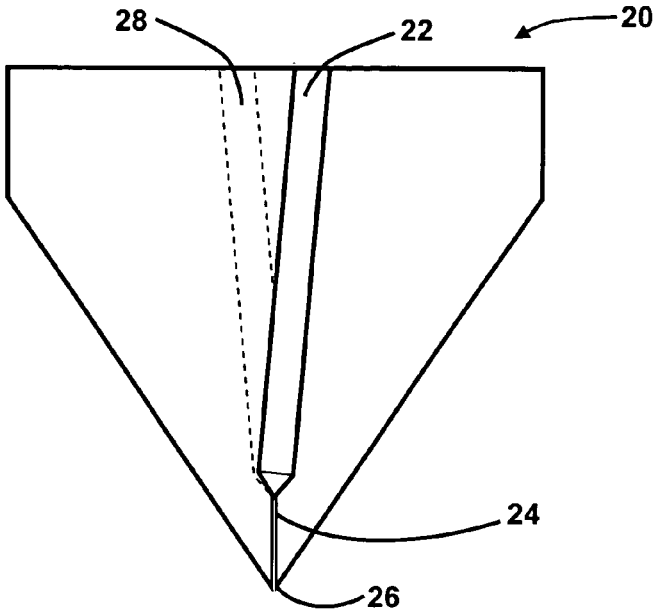
FIGS. 2A–2B illustrate schematically an embodiment of the apparatus of the invention as embodied in a meltblown die.
Figure 2B:
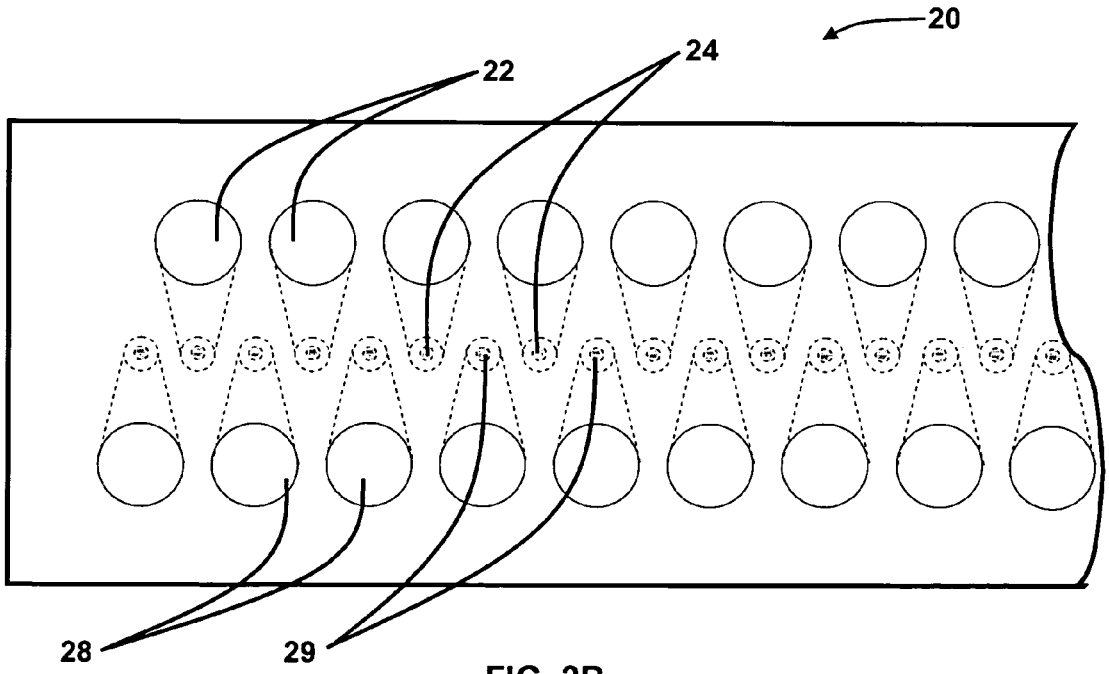

In FIGS. 2A–2B are shown embodiments of an apparatus according to the invention. FIG. 2A illustrates in side view a cut-away diagram of a meltblowing type die 20 having counterbores rather than the single deep polymer distribution channel or slot as was illustrated in FIGS. 1A and 1B. Counterbores for use in fiber production apparatus such as meltblown dies are disclosed in co-assigned U.S. Pat. No. 6,579,084 to Cook, incorporated herein by reference in its entirety. In FIG. 2A, the die 20 comprises counterbore 22, which has been drilled or otherwise formed in die 20. The counterbores will generally be cylindrical in shape, although this is not required. One or more extrusion capillaries 24 are drilled or otherwise formed extending from the bottom of or near the bottom of counterbore 22 to the extrusion edge 26 of the die. Also shown in FIG. 2A (in phantom) is the counterbore 28 which, in this side view, is behind counterbore 22. Counterbore 28 also has one or more extrusion capillaries (not shown in FIG. 2A for clarity) that are drilled or otherwise formed extending from the bottom of or near the bottom of counterbore 28 to the extrusion edge 26 of the die. Desirably, and as is shown in FIG. 2A, the two counterbores 22 and 28 are slightly offset from the midpoint or centerline of the die 20 at the top of the die and are then inclined in converging fashion toward the midpoint or centerline of the die.

FIG. 2B shows schematically a top view (rotated 90 degrees) of the meltblown die shown in FIG. 2A. As can be seen in FIG. 2B, the die 20 includes a plurality of counterbores 22 in a row along the majority of the width (that is, along the cross-machine direction dimension) of the die and has a plurality of extrusion capillaries 24 in a row along the majority of the width of the die. (The top openings of the counterbores are visible in the top view and the extrusion capillaries and subsurface features of the counterbores are illustrated in phantom.) In addition, the die 20 includes a plurality of counterbores 28 in a second row along the majority of the width of the die and includes a plurality of extrusion capillaries 29 in a second row of extrusion capillaries along the majority of the width of the die. As was discussed above with respect to FIG. 2A, the two sets of counterbores 24 and 28 may desirably be slightly offset from the midpoint of the die 20 at the top of the die, in order to allow for greater possible numbers of counterbores (and thus extrusion capillaries) along the width of the die.

As is shown in FIG. 2B, by having the counterbores offset from center at the top of the die and convergingly inclined toward center, more counterbores will fit in a unit width of the die 20 than would be the case if the two sets of counterbores were formed as a single row of exactly vertical counterbores along the center of the width of the die. Such counterbores may desirably be present in number ranging from about 2 to about 20 per inch of width of the die (from less than about 1 per centimeter to about 8 per centimeter), and more particularly from about 5 to about 10 per inch (about 2 to about 4 per cm). Although only a single extrusion capillary is shown per counterbore in FIG. 2B, as was mentioned above with reference to FIG. 2A and as is discussed below, either or both rows of counterbores may desirably have more than one extrusion capillary drilled or otherwise formed therefrom.

In use, the counterbores 22 and 28 are located in cooperation with a first and second fluid supplies, respectively, (not shown) that are located generally above the counterbores as a separate portion of the melt extrusion process connected to the meltblown die. Fluidized polymer such as molten thermoplastic polymer is pumped or otherwise provided to the die 20 by the fluid supplies. The fluid supplies may be such as heated polymer piping (not shown) as is known in the art. The first polymer is conveyed to and flows through counterbore 22 and thus to and through extrusion capillary 24 to be extruded as fine threads or filaments or fibers of molten polymer (not shown) from capillary 24 at extrusion edge 26. The second polymer is conveyed to and flows through counterbore 28 and thus to and through extrusion capillary 29 to be extruded as fine threads or filaments or fibers of molten polymer (not shown) from capillary 29 at extrusion edge 26. As mentioned above, after extrusion the fibers may be collected as a nonwoven web on a surface such as a moving belt or other forming surface. Because the counterbores 22 and 28 and their respective extrusion capillaries 24 and 29 are maintained in separate fluid communication with their respective polymer supplies, different types of fibers may be efficiently produced at the same time. And because the counterbores 22 and 28 are arranged alternatingly along the width of the extrusion die it is possible to produce nonwoven webs having a highly integrated mixtures or blendings of completely different types of fibers.

Figure 3:
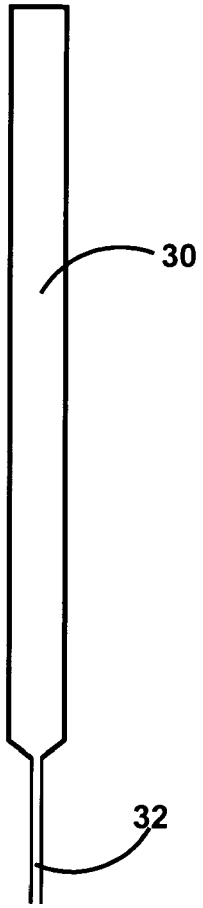
FIGS. 3, 4 and 5 illustrate schematically embodiments of a portion of the apparatus of the invention.
Figure 4:
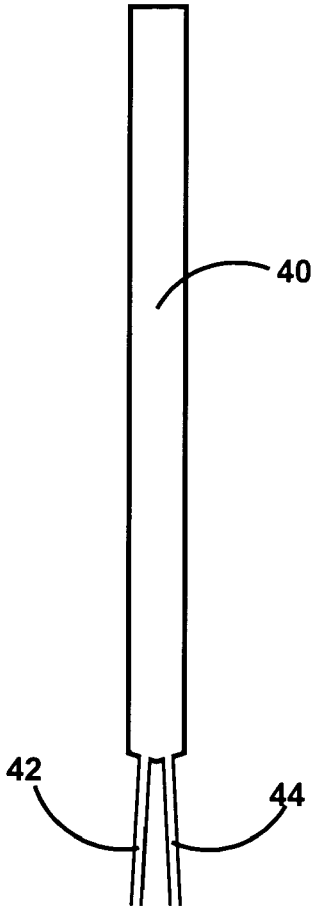
Figure 5:
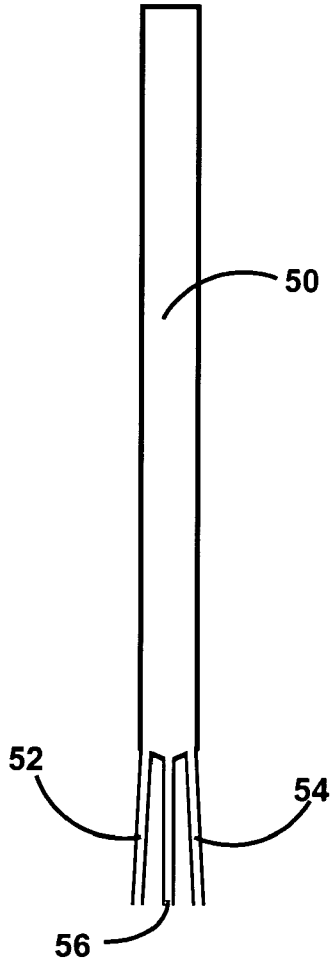

FIGS. 3–5 illustrate in side view cut-away diagrams of exemplary counterbores with extrusion capillaries extending therefrom. FIG. 3 shows counterbore 30 having extrusion capillary 32. FIG. 4 shows counterbore 40 having two extrusion capillaries, 42 and 44. FIG. 5 shows counterbore 50 having three extrusion capillaries, 52, 54 and 56. Although not shown, the number of extrusion capillaries per counterbore may be greater than the three shown. Generally speaking, the number of extrusion capillaries will range from 1 to about 10 per counterbore, and more particularly from 1 to about 5 extrusion capillaries per counterbore. In the embodiments shown above in FIGS. 2A and 2B, the two rows of counterbores (22 and 28) may be designed with varying numbers of extrusion capillaries. For example, the row comprising counterbores 22 may have only a single extrusion capillary per counterbore while the row comprising counterbores 28 may have two extrusion capillaries per counterbore, three extrusion capillaries per counterbore, four, etc. This embodiment may be particularly desirable where it is desired to produce a nonwoven web which comprises a plurality of larger diameter fibers of one type (produced by the counterbores having single capillaries) and a plurality of smaller diameters fibers of a second type (produced by the counterbores having multiple extrusion capillaries per counterbore). It should be noted that the different fiber types may be defined as differing "types" because they differ in size, shape, or composition, or any combination thereof. In another alternative, both rows may have multiple extrusion capillaries per each counterbore, either having the same number of extrusion capillaries or having differing numbers of extrusion capillaries per counterbore.

Figure 6:
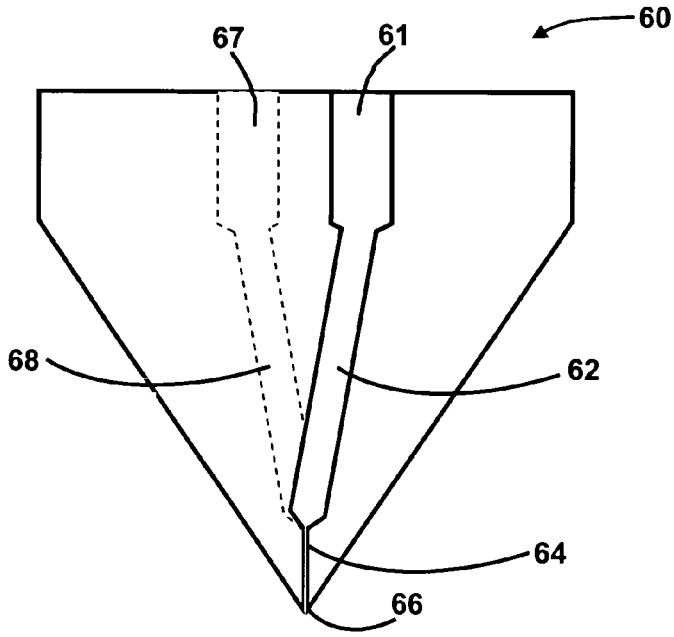
FIG. 6 illustrates schematically another embodiment of the apparatus of the invention as embodied in a meltblown die.

Another embodiment of the invention is shown in FIG. 6, which illustrates in side view a cut-away diagram of another meltblowing type die 60 which includes both a polymer distribution channel 61 formed as a slot, which is similar to but generally not as deep as polymer distribution channel 12 as illustrated in FIGS. 1A and 1B, and having counterbores 62 drilled or otherwise formed from the bottom of the polymer distribution channel 61. Extrusion capillaries 64 are drilled or otherwise formed extending from the bottom of or near the bottom of the counterbore 62 to the extrusion edge 66 of the die. Also shown in FIG. 6 (in phantom) is the polymer distribution channel 67 formed as a slot and having counterbores 68 (also shown in phantom) drilled or otherwise formed from the bottom of the polymer distribution channel 67. In this side view, both polymer distribution channel 67 and counterbore 68 are behind polymer distribution channel 61 and counterbore 62. Counterbore 68 also has one or more extrusion capillaries (not shown in FIG. 6 for clarity) that are drilled or otherwise formed extending from the bottom of or near the bottom of counterbore 68 to the extrusion edge 66 of the die. Desirably as was described above, the counterbores 62 and counterbores 68 and their respective polymer distribution channels are slightly offset from the midpoint or centerline of the die 60 at the top of the die and are then inclined in converging fashion towards the centerline of the die.

Figure 7:
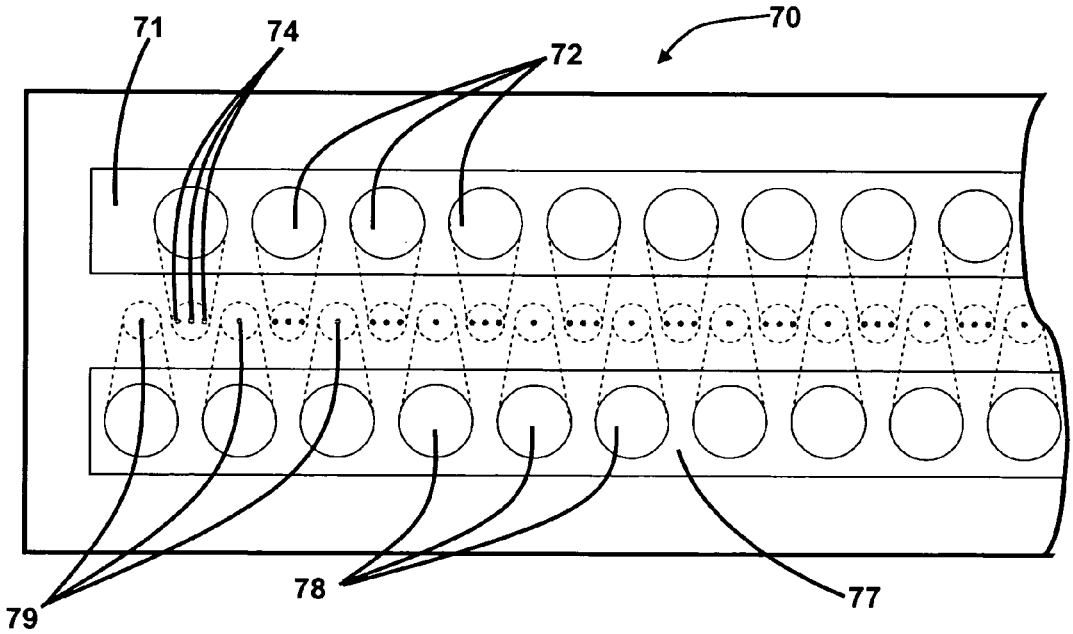
FIG. 7 illustrates another embodiment of the apparatus of the invention as embodied in a meltblown die.

FIG. 7 shows schematically a top view (rotated 90 degrees) of a meltblowing die having polymer distribution channels such as was shown in FIG. 6. As can be seen in FIG. 7, the die 70 includes for each row of counterbores (72, 78) a single polymer distribution channel (respectively, 71 and 77) along the majority of the cross-machine direction width of the die 70. In the polymer distribution channels 71 and 77 are a plurality of counterbores 72 and 78, respectively. In the embodiment shown, each counterbore 72 in polymer distribution channel 71 has three extrusion capillaries 74 while each counterbore 78 in polymer distribution channel 77 has one extrusion capillary 79. (The top openings of the counterbores are visible in the top view and the subsurface features of the counterbores and the extrusion capillaries are illustrated in phantom.) As shown in FIG. 7, the counterbores 72 and counterbores 78 may be formed on an incline toward the centerline of the die 70 such that all the extrusion capillaries 74 and 79 are substantially along a single line along the cross-machine direction centerline of the die 70.

As was mentioned above, a nonwoven web of fibers having an intimate mixture or blending of different fiber types may be produced by the invention. Alternatively, instead of an intimate mixture of fiber types, a nonwoven web may be produced having small scale regional differences such as narrow machine direction running stripes of the web wherein one stripe comprises by majority one fiber type while an adjacent stripe comprises by majority a second fiber type. These types of webs having such alternating regions will be more readily produced in the embodiments described where each counterbore has multiple numbers of extrusion capillaries.

In other embodiments, different fiber types may be achieved by feeding one polymer type (or one polymer blend type, where multiconstituent fibers may be desired) to one row of counterbores while feeding a different polymer type (or different polymer blend type) to another row of counterbores. Although not shown in the Figures, one or more additional rows of counterbores may also be included in the extrusion apparatus such that three (or more) discrete fiber types may be produced at the same time. In addition, one or more types of fibers may be multicomponent fibers as are known in the art. Multicomponent fibers in meltblowing production processes are described in U.S. Pat. No. 6,461,133 to Lake et al. and U.S. Pat. No. 6,474,967 to Haynes et al., both incorporated herein by reference in their entireties.

In other embodiments, the fibers may be of different types due to being of different sizes (whether of the same or differing polymer composition), such as may be achieved by adjusting polymer throughput rates such that the amount of polymer supplied to one row of counterbores is higher in terms of volume flow rate or mass flow rate than the amount or rate of polymer supplied to another row of counterbores. In still other embodiments, whether of the same composition and/or size, the fibers may be of different types due to being of different cross sectional shapes such as may be achieved by forming the extrusion capillaries extending from one row of counterbores in one cross sectional shape and forming the extrusion capillaries extending from another row of counterbores in another cross sectional shape. Fiber shapes known in the art include round or generally circular, ribbon-like or having a narrow rectangular shape, cross or "X"-shaped fibers, crescent shaped fibers and "T"-shaped fibers, among others.

Although the embodiments above have been described with respect to the provision of fluidized polymers to all of the extrusion capillaries, all that is required to form a nonwoven web is that at least one of the fluids supplied be a fiber forming fluid such as a fluidized polymer. However, in certain embodiments it may be desirable to provide a fiber forming fluid such as a fluidized polymer to one set of counterbores and extrusion capillaries, but to provide a non-fiber forming fluid to another set of counterbores and extrusion capillaries. As an example, it may be desirable to provide a fluidized fiber forming polymer to one set or row of counterbores and extrusion capillaries while providing air or other gas to a second set or row of counterbores and extrusion capillaries. As another example, it may be desirable to provide a fiber forming polymer to one set or row of counterbores and extrusion capillaries while providing a fluidized treatment composition to a second set or row of counterbores and extrusion capillaries, thereby imparting a treatment composition to the extruded fibers immediately upon extrusion, rather than treating the fibers as a formed web at some later point in the production process. Examples of fiber treatments include treatment to impart wettability or hydrophilicity to fibers and or webs comprising hydrophobic thermoplastic material, and antistatic treatments such as are known in the art. Another example is treatment to impart repellency to low surface energy liquids such as alcohols, aldehydes and ketones. Examples of such liquid repellency treatments include fluorocarbon compounds.

Although the embodiments of the invention have been described with respect to apparatus conventionally utilized in the melt extrusion of various types of thermoplastic filaments or fibers, we believe the invention is not limited thereto and may also be beneficially used in other types of filament or fiber extrusion processes such as for example in flash spun filament production processes and in solution spun filament production processes. However, the invention may be particularly well suited to the extrusion of thermoplastic polymer filaments or fibers. Polymers generally suitable for extrusion from a thermoplastic melt include the known polymers suitable for production of nonwoven webs and materials such as for example polyolefins, polyesters, polyamides, polycarbonates and copolymers and blends thereof. It should be noted that the polymer (or polymers, where it is desired to produce multicomponent or multiconstituent fibers) may desirably contain other additives such as processing aids or treatment compositions to impart desired properties to the fibers, residual amounts of solvents, pigments or colorants and the like.

Suitable polyolefins include polyethylene, e.g., high density polyethylene, medium density polyethylene, low density polyethylene and linear low density polyethylene; polypropylene, e.g., isotactic polypropylene, syndiotactic polypropylene, blends of isotactic polypropylene and atactic polypropylene; polybutylene, e.g., poly(1-butene) and poly (2-butene); polypentene, e.g., poly(1-pentene) and poly(2-pentene); poly(3-methyl-1-pentene); poly(4-methyl-1-pentene); and copolymers and blends thereof. Suitable copolymers include random and block copolymers prepared from two or more different unsaturated olefin monomers, such as ethylene/propylene and ethylene/butylene copolymers. Suitable polyamides include nylon 6, nylon 6/6, nylon 4/6, nylon 11, nylon 12, nylon 6/10, nylon 6/12, nylon 12/12, copolymers of caprolactam and alkylene oxide diamine, and the like, as well as blends and copolymers thereof. Suitable polyesters include poly lactide and poly lactic acid polymers as well as polyethylene terephthalate, polybutylene terephthalate, polytetramethylene terephthalate, polycyclohexylene-1,4-dimethylene terephthalate, and isophthalate copolymers thereof, as well as blends thereof.

In addition, many elastomeric polymers are known to be suitable for forming fibers. Elastic polymers useful in making extruded fibers may be any suitable elastomeric fiber forming resin including, for example, elastic polyesters, elastic polyurethanes, elastic polyamides, elastic co-polymers of ethylene and at least one vinyl monomer, block copolymers, and elastic polyolefins. Examples of elastic block copolymers include those having the general formula A-B-A' or A-B, where A and A' are each a thermoplastic polymer endblock that contains a styrenic moiety such as a poly (vinyl arene) and where B is an elastomeric polymer midblock such as a conjugated diene or a lower alkene polymer such as for example polystyrene-poly(ethylene-butylene)-polystyrene block copolymers. Also included are polymers composed of an A-B-A-B tetrablock copolymer, as discussed in U.S. Pat. No. 5,332,613 to Taylor et al. An example of such a tetrablock copolymer is a styrene-poly (ethylene-propylene)-styrene-poly(ethylene-propylene) or SEPSEP block copolymer. These A-B-A' and A-B-A-B copolymers are available in several different formulations from Kraton Polymers, LLC of Houston, Tex. under the trade designation KRATON®.

Examples of elastic polyolefins include ultra-low density elastic polypropylenes and polyethylenes, such as those produced by "single-site" or "metallocene" catalysis methods. Such polymers are commercially available from the Dow Chemical Company of Midland, Mich. under the trade name ENGAGE®, and described in U.S. Pat. Nos. 5,278,272 and 5,272,236 to Lai et al. entitled "Elastic Substantially Linear Olefin Polymers". Also useful are certain elastomeric polypropylenes such as are described, for example, in U.S. Pat. No. 5,539,056 to Yang et al. and U.S. Pat. No. 5,596,052 to Resconi et al., incorporated herein by reference in their entireties, and polyethylenes such as AFFINITY® EG 8200 from Dow Chemical of Midland, Mich. as well as EXACT® 4049, 4011 and 4041 from Exxon of Houston, Tex., as well as blends.

EXAMPLES

Figure 8:
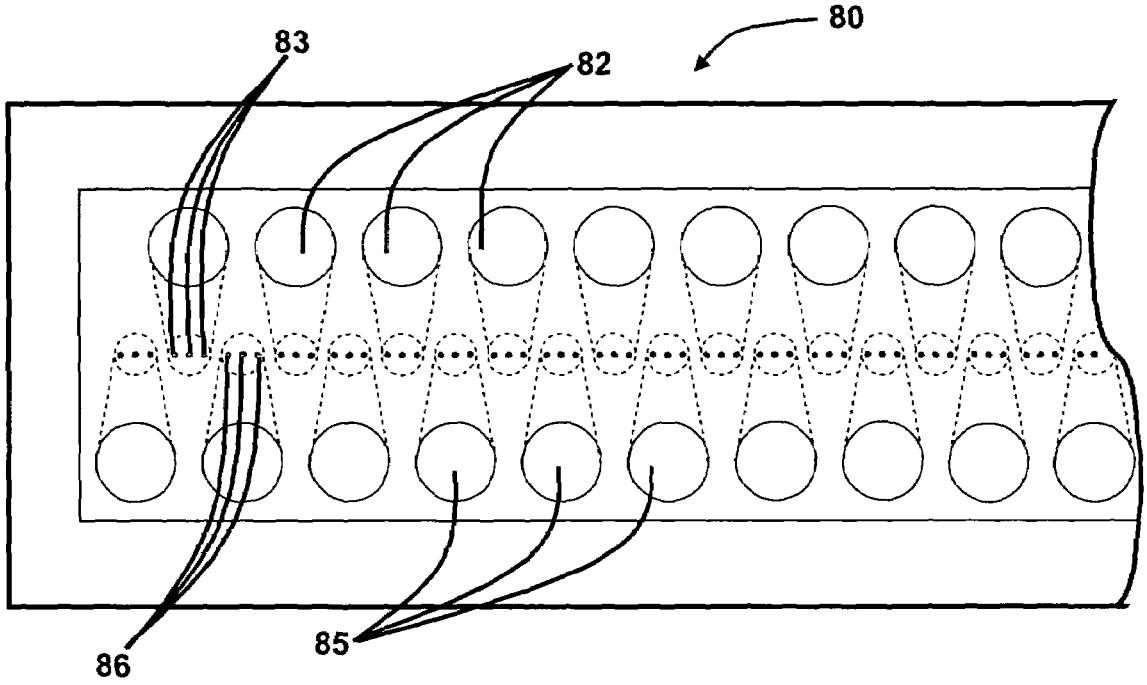
FIG. 8 illustrates another embodiment of the apparatus of the invention.

A 55.85 centimeter (cm) wide (cross-machine direction dimension) meltblowing apparatus die having 6.55 cm long nearly vertical counterbores in the die such as are described above and generally in U.S. Pat. No. 6,579,084 to Cook was manufactured having two separate rows of counterbores. The counterbores were machined on 0.25 cm centers along the cross machine direction dimension and were generally cylindrical in shape, having 0.132 cm diameters. The centerlines of the two rows of counterbores had a machine direction spacing of 0.66 cm from the cross-machine direction centerline of the meltblowing die. The counterbores were inclined convergingly such as is illustrated in FIG. 2A and FIG. 6 to a point 3.7 millimeters (mm) from the extrusion edge of the die and at the cross-machine direction centerline of the die. A schematic in top view of the meltblowing die is illustrated in FIG. 8. Die 80 includes a plurality of counterbores 82, with each counterbore having three extrusion capillaries 83. Die 80 further includes a plurality of counterbores 85, with each counterbore having three extrusion capillaries 86. (The top openings of the counterbores are visible in the top view and the subsurface features of the counterbores and the extrusion capillaries are illustrated in phantom.) As shown in FIG. 8, the counterbores 82 and counterbores 85 were formed on an incline toward the centerline of the die 80 such that all the extrusion capillaries 83 and 86 were substantially along a single line along the cross-machine direction centerline of the die 80.

A commercially available polypropylene polymer available from Basell (Elkton, Del.) and designated as PF-015, was melted by an extruder at approximately 480° F. (about 250° C.) and supplied to the meltblowing apparatus and was pumped through a polymer supply at a rate of about 1.0 pounds per inch of machine width per hour ("PIH") (about 17.9 kg/meter/hour) and was conveyed to and through the counterbores 82, and thus to the three extrusion capillaries 83 in each counterbore 82. At the same time, a commercially available polyethylene polymer, available from The Dow Chemical Company (Midland, Mich.) and designated as LLDPE DNDA-1082 NT7, was melted by a second extruder at approximately 520° F. (about 270° C.) and supplied to the meltblowing apparatus and was pumped through a second polymer supply at a rate of about 1.0 PIH (about 17.9 kg/meter/hour) and was conveyed to and through the counterbores 85, and thus to and through the three extrusion capillaries 86 in each counterbore 85.

As the two types of molten polymer were extruded from the respective extrusion capillaries 83 and 86 as extruded threads of molten polymer, the threads were entrained in and drawn by converging high velocity air streams heated to about 520° F. (about 270° C.) which attenuated the polymer threads to form meltblown filaments or fibers. The meltblown fibers were collected onto a moving foraminous forming surface to form a meltblown mat or web of fibers having about a 48 cm cross machine direction width and a basis weight of about 0.45 osy (about 15 gsm). Because of the alternating arrangement of the two different rows of counterbores, the nonwoven web thus produced (Sample 1) was a mixture or blend of polypropylene fibers and polyethylene fibers.

Second and third sample nonwoven webs were produced having approximately the same basis weight (measured basis weights are reported in TABLE 1) and using the same polymers and but the relative polymer throughput rates were varied. For production of the second nonwoven web (Sample 2), the polypropylene polymer throughput was about 1.5 PIH (about 26.8 kg/meter/hour) while the polyethylene polymer throughput was about 0.5 PIH (about 8.9 kg/meter/hour), such that the nonwoven web produced was about 75 percent by weight polypropylene and about 25 percent by weight polyethylene. For production of the third sample nonwoven web (Sample 3), the polypropylene polymer throughput was about 0.5 PIH (about 8.9 kg/meter/hour) while the polyethylene polymer throughput was about 1.5 PIH (about 26.8 kg/meter/hour), such that the nonwoven web produced was about 75 percent by weight polyethylene and about 25 percent by weight polypropylene.

Other sample webs were produced using the same polypropylene (PP) polymer and substituting a polybutylene terephthalate (PBT) polymer available from Ticona (Celanese AG) of Kelsterbach, Germany under the trade name Ticona Celanex PBT 2008 for the polyethylene polymer. The PBT polymer was melted by an extruder at approximately 540° F. (about 280° C.) and supplied to the meltblowing apparatus and nonwoven webs comprising polypropylene fibers and PBT fibers were produced at about 0.45 osy (about 15 gsm). As in the examples above, webs were produced having about 50 weight percent each of the two fiber types (Sample 4) by pumping each of the respective polymers at a rate of about 1.0 PIH (about 17.9 kg/meter/hour). In addition, two other PP/PBT webs, Sample 5 and Sample 6, were made having about 25/75 fiber type weight percent distribution (PBT/PP, respectively) and 75/25 fiber type weight percent distribution (PBT/PP, respectively).

In addition, another web (Sample 7) was produced with the polybutylene terephthalate polymer and the polyethylene polymer by pumping each of the respective polymers at a rate of about 1.0 PIH (about 17.9 kg/meter/hour) to produce a nonwoven web having about a 50/50 fiber type weight percent distribution of the PBT and polyethylene fibers.

The sample webs thus produced were tested to determine their basis weight, tensile strength, liquid barrier (supported hydrohead) property and air permeability or breathability. The results of the testing are reported in TABLE 1. Hydrohead is a measure of the liquid barrier properties of a material and determines the height of water or amount of water pressure (in millibars) that the fabric will support before liquid passes through. A fabric with a higher hydrohead reading indicates better barrier to liquid penetration. Hydrohead may be obtained in accord with Federal Test Standard 191A, Method 5514 except that unsupported materials, such as a thin film or more easily ruptured nonwovens such as meltblown webs, are supported to prevent premature rupture of the specimen. Tensile strength may be tested as grab tensile strengths measuring the peak load (the maximum load before the specimen ruptures) in accordance with ASTM D5034-90, using rectangular 4 inch by 6 inch (100 mm by 150 mm) specimens to be. The peak strain as a percentage of specimen extension at rupture may also recorded. The air permeability determines the airflow rate through a specimen for a set area size and pressure. The higher the airflow rate per a given area and pressure, the more open the material is, thus allowing more fluid to pass therethrough. Air permeability data may be conducted in accordance with the specifications of Federal Test Methods Standard No. 191 A, method 5450.

As can be seen in TABLE 1, despite being formed from differing fiber types (i.e., fibers having different polymeric compositions), all the Sample web materials had good tensile strength, breathability and liquid barrier properties.

TABLE 1

| Sample ID | Basis Weight (gsm) | Air Perm. (m3/min) | Sup'td Hydro (mbar) | Tensile Load (grams) MD | Tensile Load (grams) CD | Tensile Strain (%) MD | Tensile Strain (%) CD |
|---|---|---|---|---|---|---|---|
| 1 | 15.4 | 4.6 | 42 | 1111 | 944 | 36 | 55 |
| 2 | 13.8 | 3.9 | 46 | 1313 | 1251 | 35 | 52 |
| 3 | 13.5 | 3.1 | 58 | 1559 | 1369 | 41 | 40 |
| 4 | 13.1 | 3.3 | 41 | 990 | 765 | 41 | 45 |
| 5 | 13.9 | 2.7 | 61 | 733 | 769 | 27 | 28 |
| 6 | 14.7 | 5.1 | 16 | 815 | 654 | 44 | 69 |
| 7 | 15.3 | 4.6 | 34 | 263 | 622 | 31 | 79 |

While various patents have been incorporated herein by reference, to the extent there is any inconsistency between incorporated material and that of the written specification, the written specification shall control. In addition, while the invention has been described in detail with respect to specific embodiments thereof, it will be apparent to those skilled in the art that various alterations, modifications and other changes may be made to the invention without departing from the spirit and scope of the present invention. It is therefore intended that the claims cover all such modifications, alterations and other changes encompassed by the appended claims.

The invention claimed is:

1. An apparatus for making a fibrous nonwoven web, said apparatus comprising:

a) an extrusion die;

b) a first fluid supply in cooperation with said extrusion die and a second fluid supply in cooperation with said extrusion die;

c) a plurality of first extrusion capillaries and a plurality of second extrusion capillaries; and d) first counterbores allowing fluid communication between said first extrusion capillaries and said first fluid supply, and second counterbores allowing fluid communication between said second extrusion capillaries and said second fluid supply;

wherein each of said first counterbores has at least two of said first extrusion capillaries extending therefrom and each of said second counterbores has at least one of said second extrusion capillaries extending therefrom.

2. The apparatus of claim 1 wherein each of said first counterbores has at least three of said first extrusion capillaries extending therefrom.

3. The apparatus of claim 1 wherein each of said second counterbores has at least two of said second extrusion capillaries extending therefrom.

4. The apparatus of claim 1 comprising between 2 and about 20 counterbores per inch of said die.

5. The apparatus of claim 1 further comprising a third fluid supply, wherein said second counterbores allow fluid communication between said second extrusion capillaries and said third fluid supply.

6. The apparatus of claim 1 further comprising a third fluid supply, a plurality of third extrusion capillaries and comprising third counterbores allowing fluid communication between said third extrusion capillaries and said third fluid supply.

* * * * *